US007631708B2

(12) United States Patent
Billingsley

(10) Patent No.: US 7,631,708 B2
(45) Date of Patent: Dec. 15, 2009

(54) METHOD AND APPARATUS FOR HORIZONTAL DRILLING AND OIL RECOVERY

(76) Inventor: Robert Billingsley, 6303 Pleasant Stream, Katy, TX (US) 77449

( * ) Notice: Subject to any disclaimer, the term of this patent is extended or adjusted under 35 U.S.C. 154(b) by 175 days.

(21) Appl. No.: 11/590,532

(22) Filed: Oct. 31, 2006

(65) Prior Publication Data

US 2007/0151765 A1 Jul. 5, 2007

Related U.S. Application Data

(63) Continuation-in-part of application No. 11/319,112, filed on Dec. 27, 2005, now abandoned, which is a continuation-in-part of application No. 11/079,705, filed on Mar. 14, 2005, now abandoned, which is a continuation-in-part of application No. 09/954,891, filed on Sep. 18, 2001, now abandoned.

(60) Provisional application No. 60/233,115, filed on Sep. 18, 2000.

(51) Int. Cl.
*E21B 7/04* (2006.01)

(52) U.S. Cl. ..... 175/78; 175/62

(58) Field of Classification Search ..... 175/77, 175/78, 62

See application file for complete search history.

(56) References Cited

U.S. PATENT DOCUMENTS

| | | | | | |
|---|---|---|---|---|---|
| 2,622,231 | A | * | 12/1952 | Gray | 318/637 |
| 2,889,137 | A | * | 6/1959 | Walker | 175/52 |
| 3,301,337 | A | * | 1/1967 | Vaughn et al. | 175/22 |
| 3,720,262 | A | * | 3/1973 | Grable | 166/298 |
| 4,226,288 | A | * | 10/1980 | Collins, Jr. | 175/62 |
| 4,630,967 | A | * | 12/1986 | Soltau | 405/184 |
| 4,691,788 | A | * | 9/1987 | Yoshida et al. | 175/62 |
| 5,133,418 | A | * | 7/1992 | Gibson et al. | 175/45 |
| 6,050,351 | A | * | 4/2000 | Eckenfels et al. | 175/62 |

* cited by examiner

*Primary Examiner*—Hoang Dang

(57) ABSTRACT

An oil tool forms holes or perforations which extend horizontally away from the borehole and into the formation for recovering additional oil and gas from the formation. The tool provides a downhole tool capable of drilling horizontally into a formation and further capable of operating in a relatively small well bore, such as those having a diameter of less than six inches. In addition, the tool does not tend to spiral or otherwise deviate from horizontal during drilling operations. The tool of the present invention includes a drill capable of drilling or tunneling through the formation, a magazine or carrier which contains a plurality of hollow joints or segments, a hydraulic pump and a mechanism for assembling and disassembling the segments. Once in place, the assembly mechanism removably attaches a segment from the magazine to the drill.

6 Claims, 12 Drawing Sheets

METHOD AND APPARATUS FOR HORIZONTAL DRILLING AND OIL RECOVERY

This invention is a continuation-in-part of patent application Ser. No. 11/319,112 filed on Dec. 27, 2005, now abandoned which is a continuation-in-part of patent application Ser. No. 11/079,705 filed Mar. 14, 2005 now abandoned which is a continuation of patent application Ser. No. 09/954,891, filed Sep. 18, 2001 now abandoned and provisional application Ser. No. 60/233,115, filed on Sep. 18, 2000 entitled "Method and Apparatus for Horizontal Drilling and Oil Recovery." Priority is claimed from each of the above noted patent applications which are enclosed in their entirety by reference herein. The invention is generally related to drilling and producing oil from abandoned wells and is specifically directed to horizontal drilling and perforating such wells. This invention can be used with a wire truck in combination with a power truck or with a drilling rig.

BACKGROUND OF THE INVENTION

1. Field of the Invention
2. Description of the Prior Art

As oil supplies continue to deplete, the ability to recover additional oil from existing and/or abandoned well sites or formations becomes of greater importance. One method for recovering additional oil and gas from a formation is to create holes or perforations which extend horizontally away from the borehole and into the formation.

There are tools in the industry capable of forming horizontal bores or holes. These can generally be categorized as (1) hydraulic or (2) flexible shaft tools. As shown in U.S. Pat. No. 4,317,492 (Summers), U.S. Pat. No. 5,439,066 (Gipson) and U.S. Pat. No. 5,853,056 (Landers), U.S. Pat. No. 5,934,390 (Uthe), hydraulic fluid can be used to create holes or perforations in oil bearing formations. Typically a hose or tube is passed down the exiting well bore to a point where the horizontal bore is desired. The hose extends from the surface, where a pump provides pressurized hydraulic fluid, such as water, to erode the rock or sand surrounding the downhole end of the hose. While somewhat effective in forming holes in the strata surrounding the main bore, this method significantly damages the formation, which may hinder additional oil or gas production.

Many tools, such as that shown in U.S. Pat. No. 4,226,288 (Collin), as well as those shown in the '056 and '066 patents, provides a flexible shaft which extends from the surface, down the main bore and then turns or bends to extend horizontally into the formation, traveling generally perpendicular to the main bore. While these tools may be suitable for use in very large well bores, they are not suitable for use in wells having smaller bores because the turning radius of the flexible shaft is too great. Additionally, those tools which turn the entire shaft to provide rotation of a drill bit do not typically travel perpendicular to the well bore. The rotation of the shaft creates a downward spiraling of the drill bit.

SUMMARY OF THE INVENTION

The present invention provides a method and apparatus for forming holes or perforations which extend horizontally away from the borehole and into the formation for recovering additional oil and gas from the formation. The present invention provides a downhole tool capable of drilling horizontally into a formation and further capable of operating in a relatively small well bore, such as those having a diameter of less than six inches. In addition, the tool does not tend to spiral or otherwise deviate from horizontal during drilling operations. The tool of the present invention includes a drill capable of drilling or tunneling through the formation, a magazine or carrier which contains a plurality of hollow joints or segments, a hydraulic pump and a mechanism for assembling and disassembling the segments. Once in place, the assembly mechanism removably attaches a segment from the magazine to the drill.

DETAILED DESCRIPTION OF THE PREFERRED EMBODIMENTS

Figure 1:
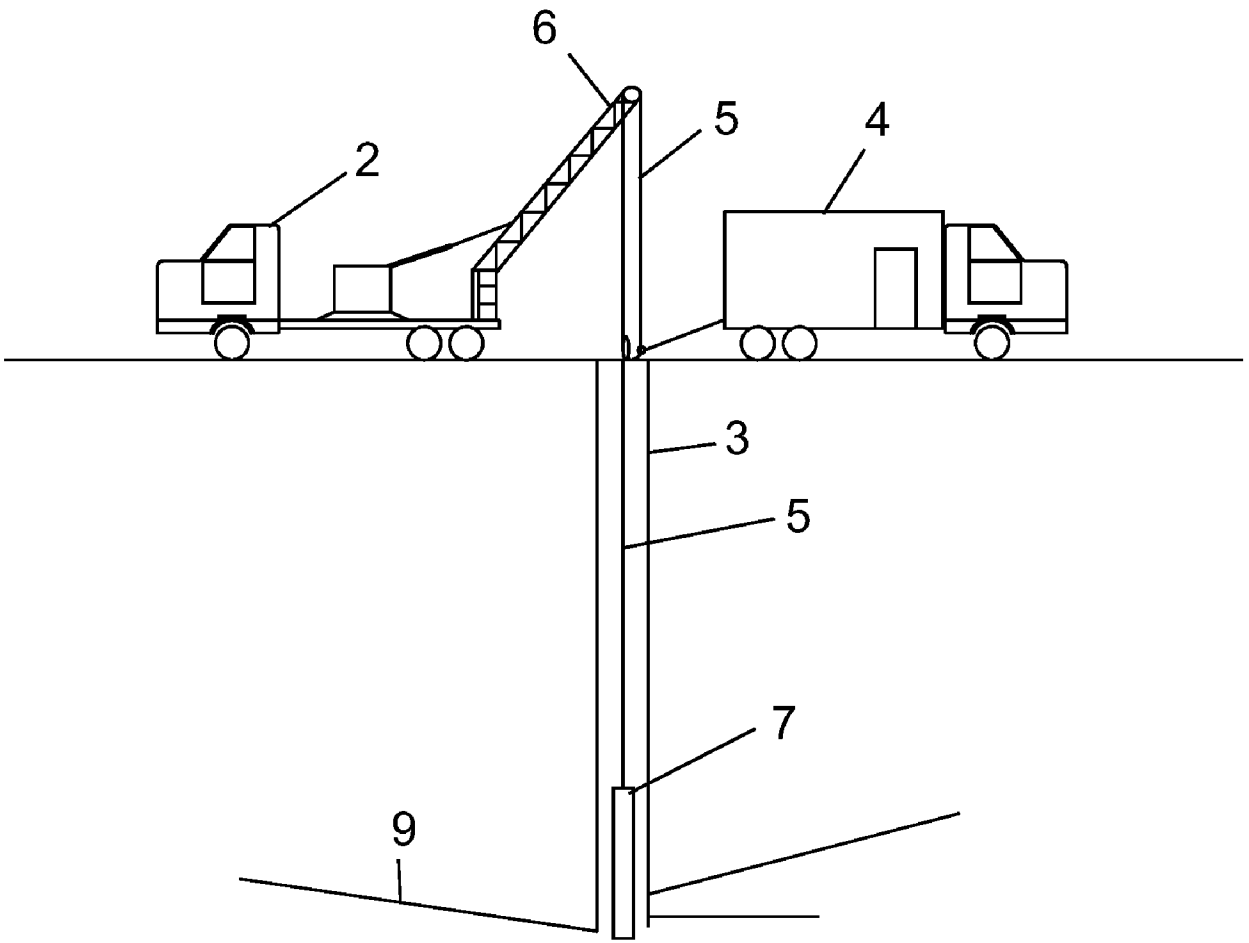
FIG. 1 is a diagrammatic view of a system for horizontal drilling and oil recovery, showing the drill perforation and surface equipment.

The overall system diagram is shown in FIG. 1. A mast truck 2 is utilized for hoisting and lowering the tool into the well bore 3 in the well known manner. A power and control truck 4 pays the wireline 5 over the outer reach of the mast 6 and into the well bore 3. The housing assembly 7 is secured to the end of the wireline 5. The housing assembly houses the horizontal drilling system of the subject invention and permits horizontal drilling outwardly from the vertical well bore 3, as shown at 9.

Figure 2:
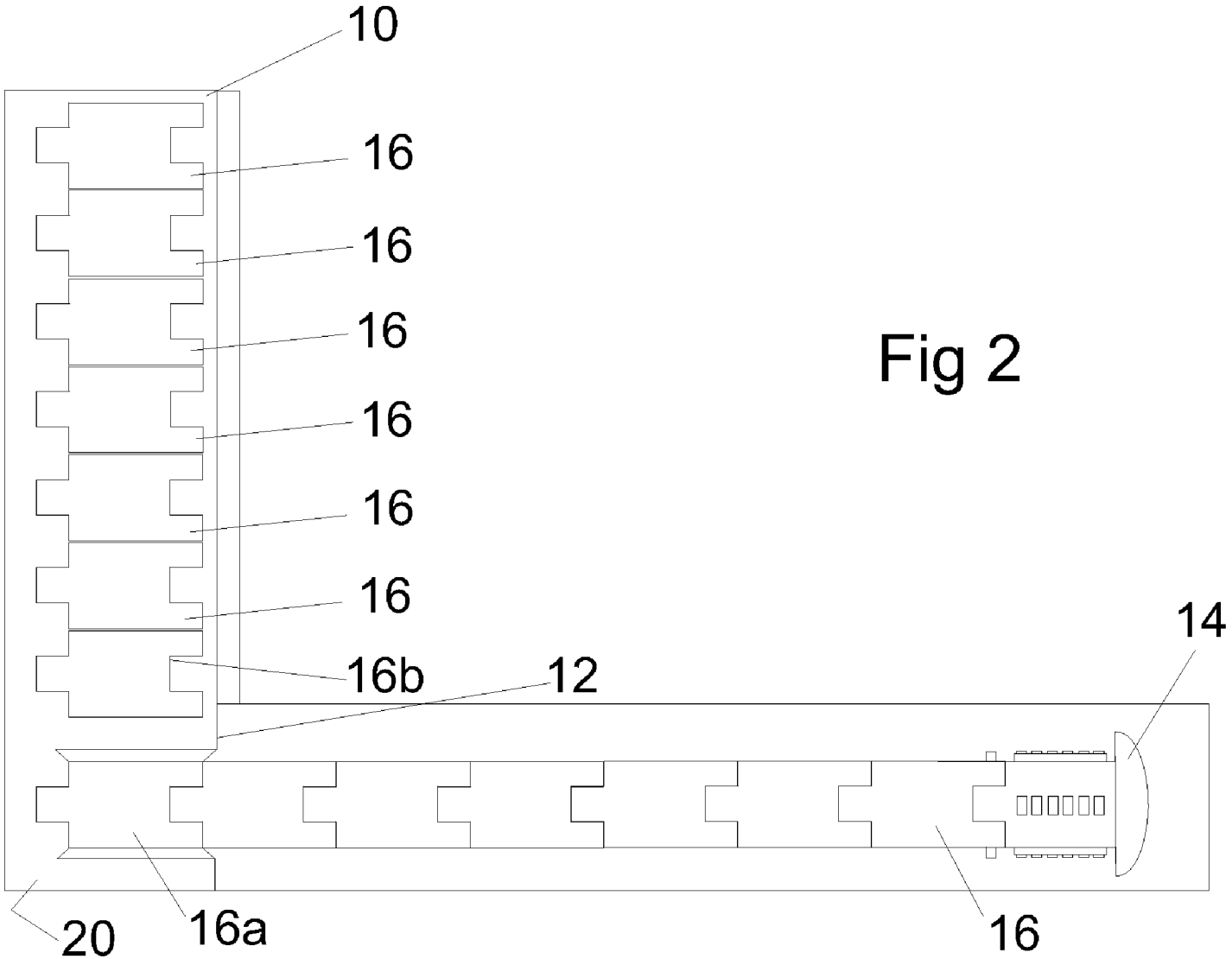
FIG. 2 is an illustration of the vertical bore hole, a horizontal bore hole and the assembly of the subject invention.

As shown in FIG. 2, the present invention provides a downhole tool capable of drilling horizontally into a formation and further capable of operating in a relatively small well bore, such as those having a diameter of less than six inches. The well bore 10 is perforated at the opening 12 for accommodating a horizontal drill bit 14. The drill bit is mounted on the front end of a magazine segment 16. The well bore 10 serves as a storage cell for a plurality of segments 16, forming a magazine 18. As the bit 14 moves horizontally into the strata, segment 16A will advance out of the wellbore 10. At this point the next in line segment 16B will drop into the loading cell 20 and couple to the next ahead segment 16A, permitting the bit 14 to progress further in a horizontal direction. In addition, the tool does not tend to spiral or otherwise deviate from horizontal during drilling operations. As the drill advances into the formation, the assembly mechanism affixes additional segments, which are fed from the magazine.

Figure 3:
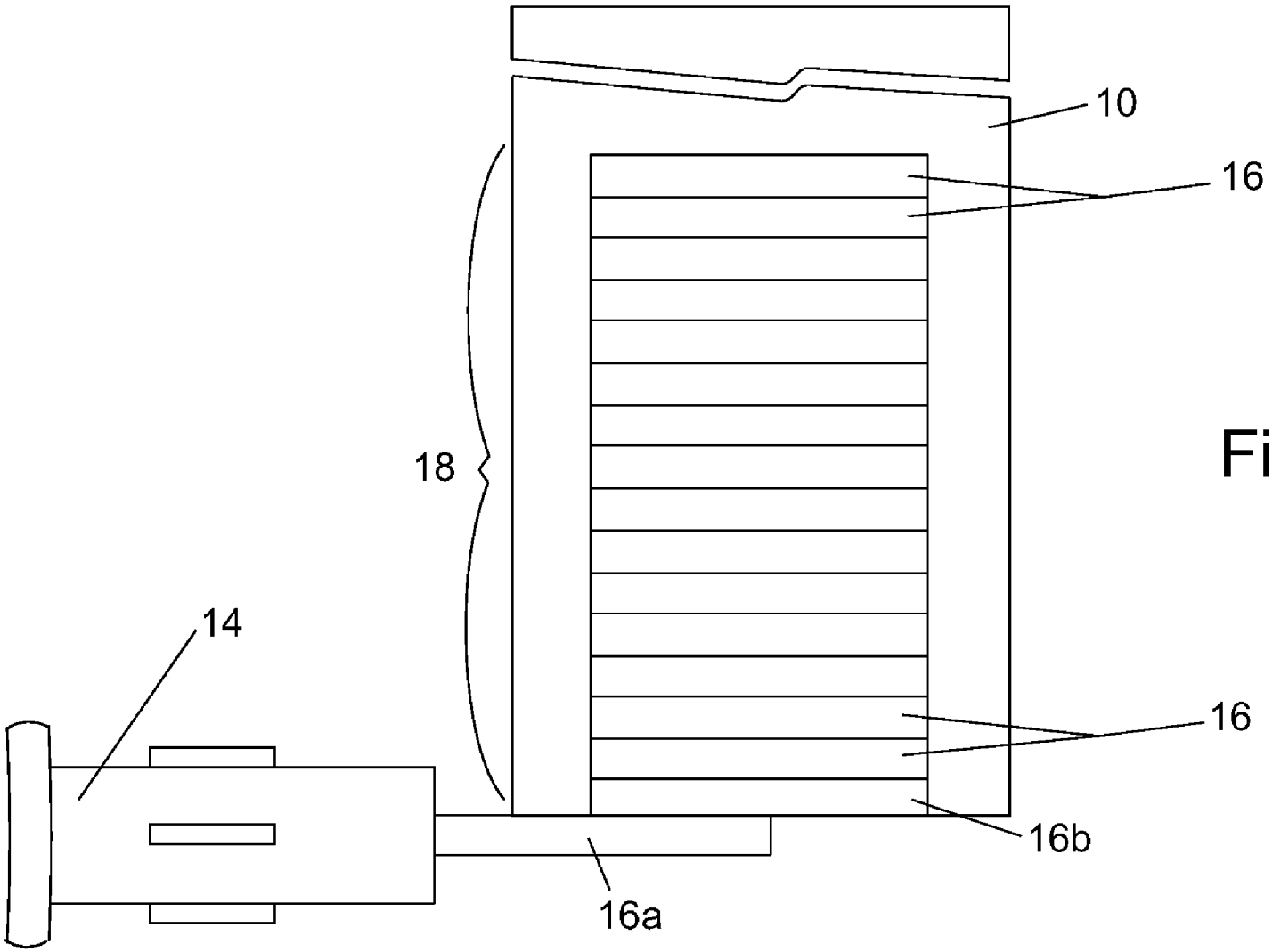
FIG. 3 is similar to FIG. 2 and shows an alternative embodiment.

An alternative embodiment is shown in FIG. 3 and operates in the same manner as that shown in FIG. 2.

Specifically, the tool of the present invention includes a drill capable of drilling or tunneling through the formation, a magazine or carrier which contains a plurality of hollow joints or segments, a hydraulic pump and a mechanism for assembling and disassembling the segments. Initially, the tool is lowered into the bore, down to the desired level using known wireline techniques. Once at its destination, the tool may be removably affixed in the bore using any suitable method or mechanism to prevent movement of the tool during operation. Once in place, the assembly mechanism removably attaches a segment from the magazine to the drill. Hydraulic fluid from the pump may then be passed through the hollow segment to the drill to power the bit. The drill then travels out of the tool through an opening or aperture therein and into the formation. The pump of the present invention is preferably located in the tool itself, rather than at the surface. As the drill advances into the formation, the assembly mechanism affixes additional segments, which are fed from the magazine, onto the previously attached or assembled segment. Once the horizontal bore is formed, the drill may be drawn back into the tool. After completing a horizontal bore, the tool may be raised or lowered for further drilling or may simply be rotated to allow an additional horizontal bore to be formed at the same depth. It will be understood by those who are skilled in the art that electrical power or other power systems could be substituted for the hydraulic power system of the illustrated embodiment.

Figure 4:
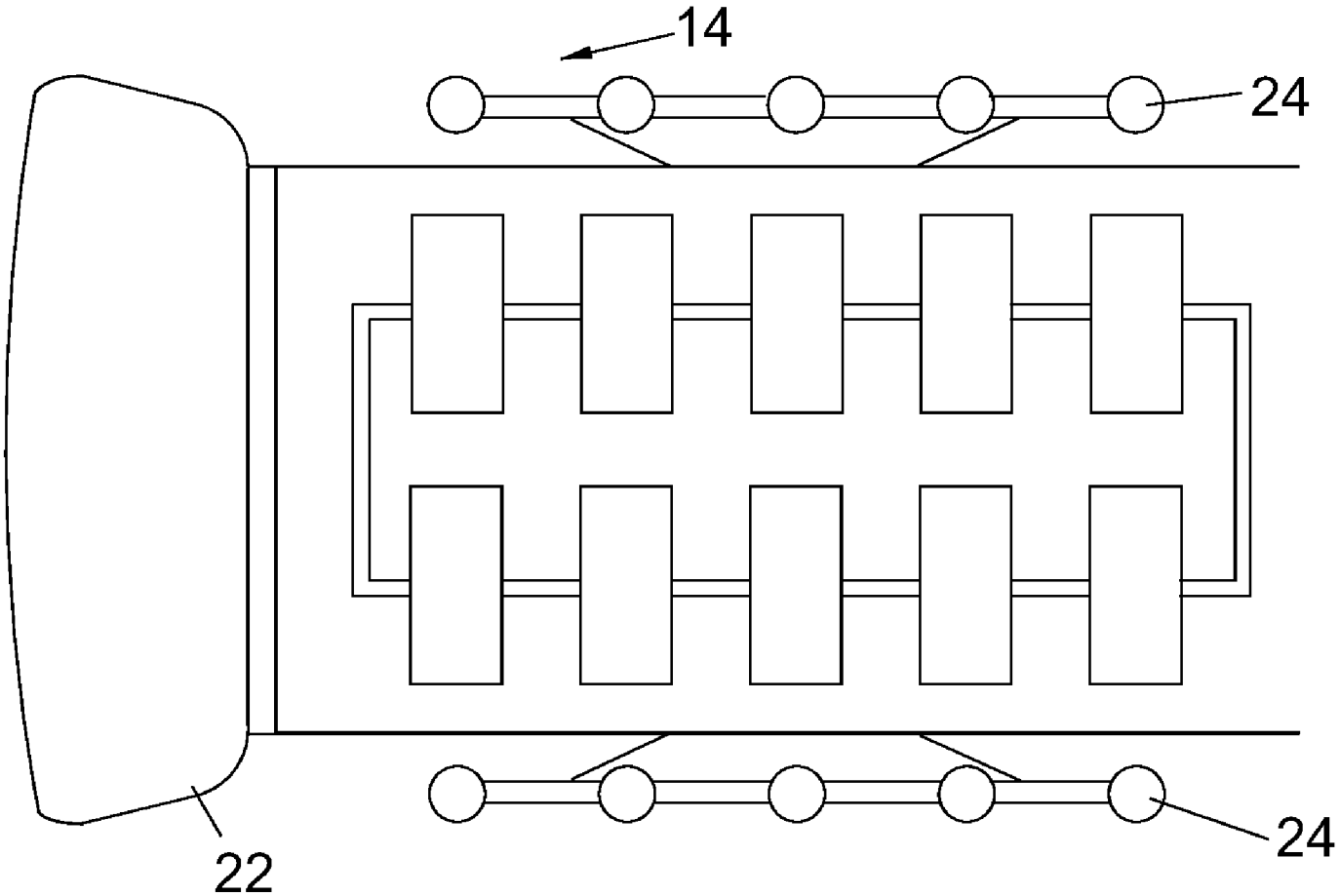
FIG. 4 is an illustration of a drill bit used in accordance with the subject invention.

Although any suitable drill may be used, as shown in FIG. 4, the drill typically incorporates a suitable bit 22 and a plurality of drive mechanisms such as the drive wheels or axles 24 disposed on the exterior of the drill to aid in driving or pushing the bit forward into the formation and to provide stability for the bit during operation. Hydraulic fluid from a pump turns the bit in the manner well known to those who are skilled in the art and provides power to the drive mechanism. The drive mechanism may include wheels, tracks or any other suitable device. Preferably, a plurality of tracks are affixed in a spaced manner about the outside of the bit.

The segments preferably have a hexagonal or octagonal shape to add rigidity and prevent bending during drilling. Each segment has a first, leading end and a second, trailing end. The leading end of each segment corresponds to the trailing end of the segment before it. In this way, the segments may be removably joined by the assembly mechanism and passed into the newly formed horizontal bore. For example, corresponding first and second ends may be threaded internally and externally, respectively. Corresponding ends may have any suitable interlocking arrangement. The segments have a diameter smaller than that of the hole or bore formed by the drill bit. Preferably, each segment is approximately three inches in length and may be formed from any suitable material, but preferably a metal such as steel. It may be desirable, in certain instances, to include stabilizers, spacers or support devices at spaced intervals along the assembled segments. Such devices provide support for the segments and prevent bending of the assembled segments, which may occur due to the smaller diameter of the segments relative to the horizontal bore. Where these devices are used, they are typically slotted to allow fluid and cuttings to pass out of the horizontal bore. The magazine or carrier may be sized to contain any number of segments, preferably; however, the carrier accommodates enough segments to allow the drill to travel approximately forty feet from the main bore. This is approximately five times the capability of known methods.

Figure 5:
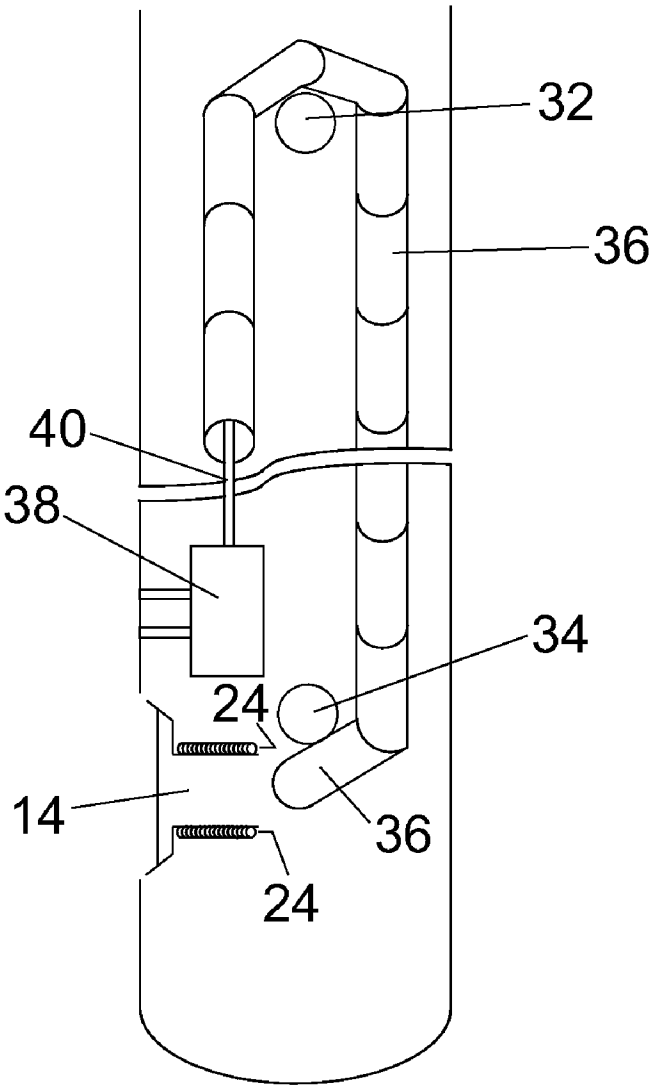
FIG. 5 shows an alternative embodiment for feeding the segments of the system in accordance with the subject invention.

In a another embodiment, and as shown in FIG. 5, the present invention is a downhole horizontal drilling tool which includes a drill, a linked chain drive system and a hydraulic pump. The drill preferably has a plurality of drive mechanisms 24 positioned thereon, as previously described. Hydraulic fluid from the pump drives the drill bit and drive mechanism.

The linked chain drive system includes at least a pair of pulleys 32, 34, one of which may be moved axially within the tool, a linked chain of segments 36, and a drive motor 38. Preferably, the linked chain is hollow to allow fluid to pass therethrough. The last segment in the linked chain is attached to the drill 14. As the drill travels into the formation, the linked chain is pulled into the formation as well. As the linked chain travels into the formation, an upper, axially moveable pulley 32 travels axially downward, thereby allowing the chain to travel out into the formation while keeping tension in the chain and controlling the rate at which it travels. A lower, fixed pulley 34 allows the chain to turn out of the tool and into the formation. Additional pulleys may be used to further control the movement of the linked chain. The motor 38 controls the movement of the upper pulley and may rotate drill stem 40 inside the linked chain. Alternatively, a pump may supply a hydraulic fluid through the chain to turn the drill bit and drive the drive mechanisms in the manner well known. Once the horizontal bore is formed, the drill and linked chain is drawn back into the tool.

More detailed illustrations of the drill segments or links are shown in FIGS. 6A-9C. The drill bit and drive assembly is shown in more detail in FIG. 11.

Figure 6A:
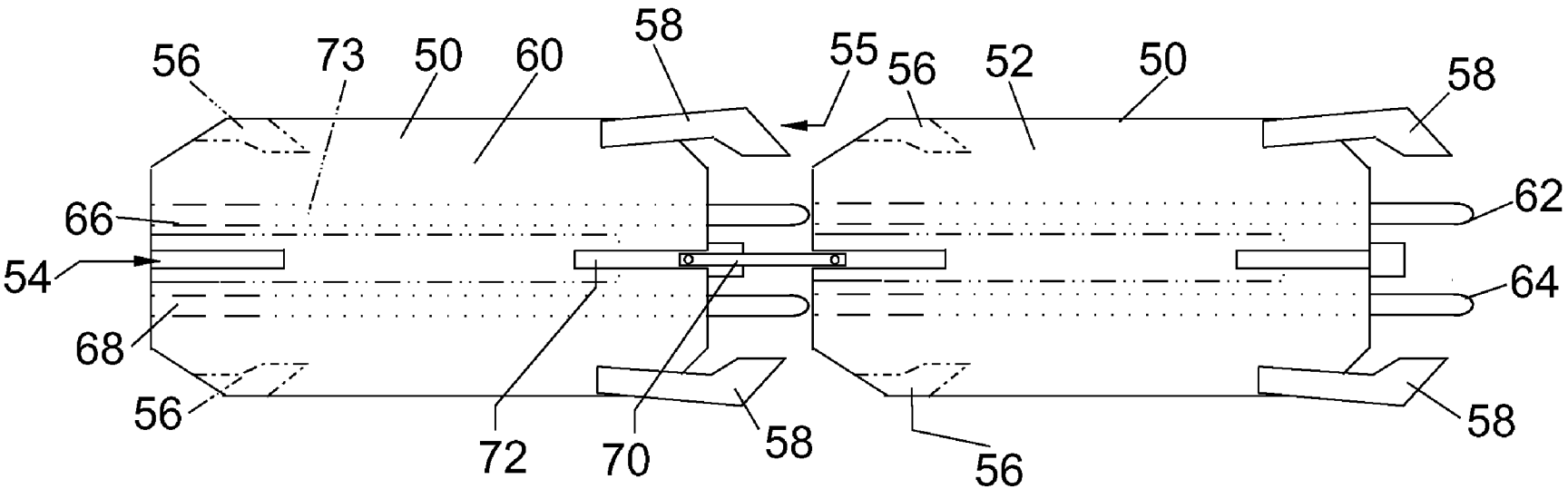
FIGS. 6A, 6B, 6C, 6D and 6E show the chain links for a drill pushing assembly.
Figure 6B:
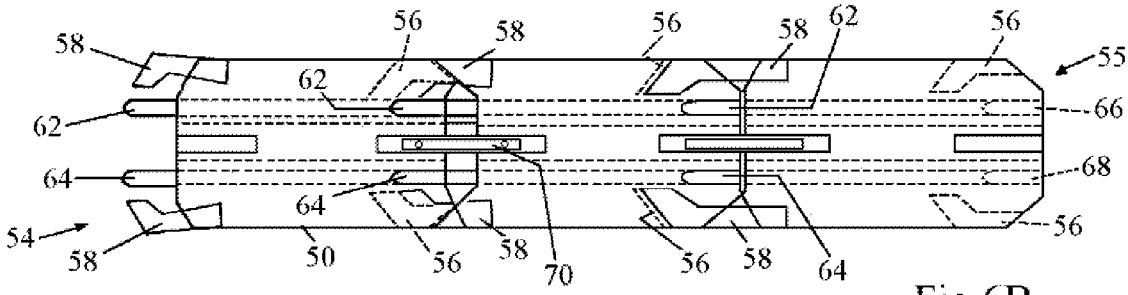
Figure 6D:
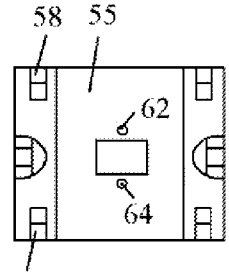

With specific reference to FIGS. 6A-6D, each link 50 comprises an outer housing or shell 52. In the illustrated embodiment the link housing is of rectangular cross-section as shown in the end views 6B and 6C. One end, the rearward end 54 houses four locking slots 56. The opposite or forward end 58 includes complementary hinged locking pins 60. As shown in FIG. 6D, the locking pins 60 hook into the mated slots 58 as the links are axially aligned. This assures that the multiple links stay in coupled and aligned relationship as the assembly moves through a bore, as shown, from left to right.

Figure 6E:
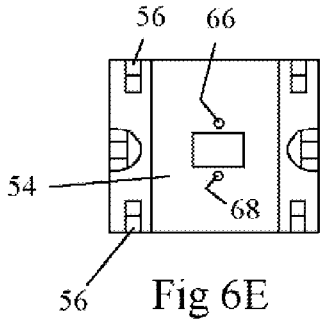
Figure 6C:
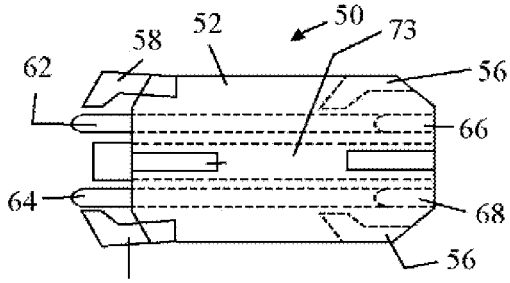

Each of the links also includes a pair of electrical connector pins 62, 64. Typically, one pin will be charged positive and the other negative. The pins are adapted to engage mated boxes 66, 68, respectively, when the links are in mated engagement as shown in FIG. 6D. Couplers 70 may be mounted in the housing slots 72, as shown, for coupling the links together, again as shown in FIGS. 6D and 6E. The center portion of each link includes an axial opening 72 which is open at each end to permit drilling fluids to pass through the links.

Figure 7C:
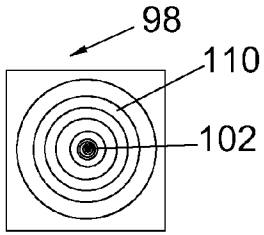
FIGS. 7A, 7B, and 7C illustrate the drill segments as assembled for pushing a self-propelled drill bit.
Figure 7B:
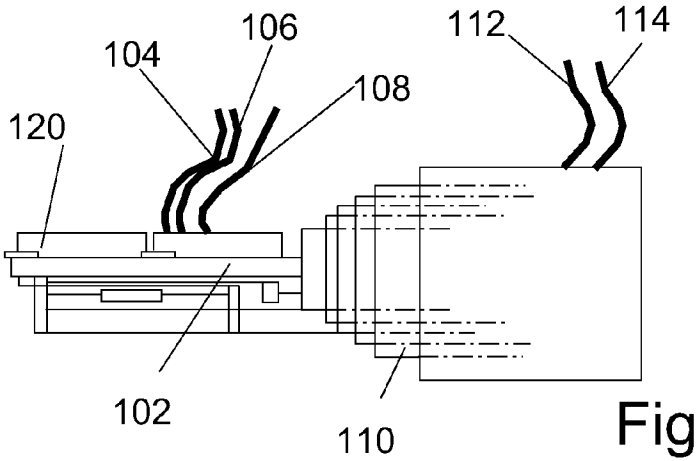
Figure 7A:
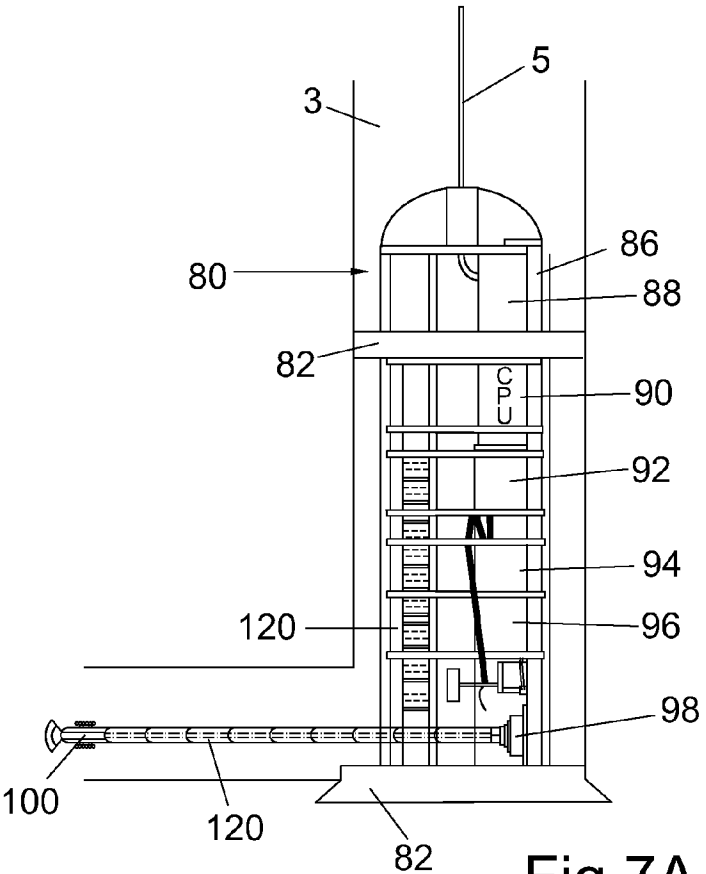

As shown in FIG. 7A, the drilling tool of the subject invention is carried in a housing 80 which is mounted on the end of the wireline 5 and lowered in the well bore 3 by the mast truck 5. (See FIG. 1). A spacer 82 is placed at each end of the housing for holding the tool in the center of the well bore. A chamber 84 is provided in the housing for carrying a plurality of stacked links 50. A second chamber 86 in the housing houses the electrical power converter 88 which is coupled to the surface control truck 4 via the wireline 5. The control CPU 90, power supply 92, drilling fluid reservoir 94 and hydraulic fluid reservoir 96 are also housed in the chamber 86. The power converter system 98 engages the last link 50 as the drill bit 100 moves horizontally outward from the well bore 3.

The power converter system 98 is better shown in FIGS. 7B and 7C. As each link 50 drops into position, the spindle 102 engages the central bore 74 of the link. The electrical lines 104, 106 are secured to the converter system and electrically connected to the electrical pin and box in the link and previously described. The drilling fluid is introduced into the central bore via line 108. As series of nested pusher cylinders 110 are concentric with the spindle and are controlled by the hydraulic lines 112, 114 which are coupled to the hydraulic fluids reservoir 96. These cylinders may be activated to push the engaged link into the horizontal bore. Once this is accomplished, then the cylinders are withdrawn to the nested position and the next link is dropped into place to be engaged by the spindle 102 and the process is repeated.

Figure 8A:
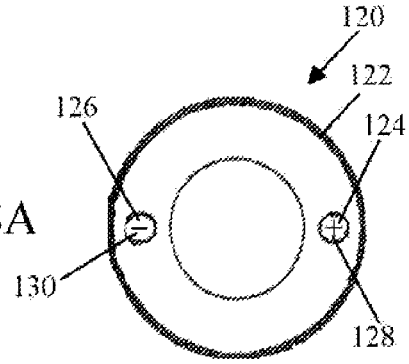
FIGS. 8A, 8B and 8C illustrate the coupling stem mechanism for the drill segments in accordance with FIGS. 7A-7C.
Figure 8B:
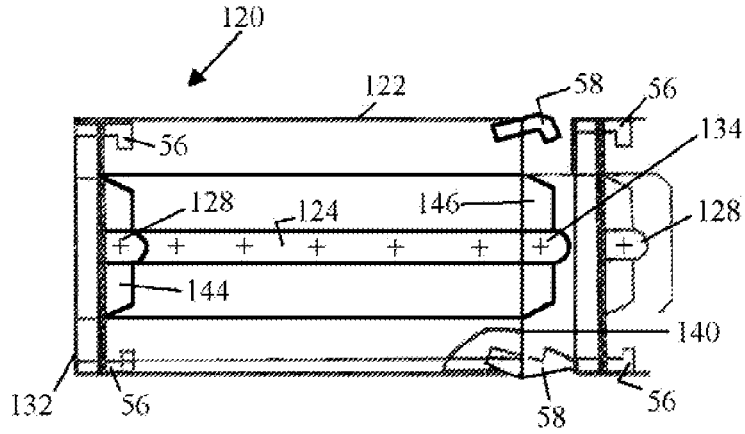
Figure 8C:
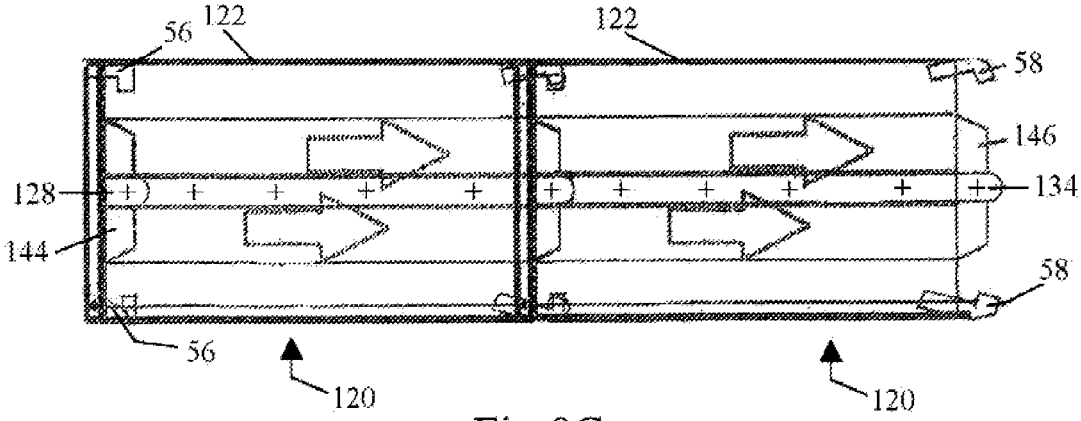

An alternative link configuration is shown in FIGS. 8A-8C. In this configuration the link 120 has a housing 122 which is of a generally cylindrical cross-section, see FIG. 8A. The electrical pin and box system includes a recessed pin 124 for positive charge and a recessed pin 126 for negative charge. The recess creates a respective box 128 and 130 at one end 132 of the link and a projecting, mated pin 134 and 138 at the opposite end 140 of the link. The central bore 142 carries the drilling fluids. The back end 132 of each link includes a beveled receptacle 144. The opposite or front end 140 includes a mated beveled pin 146. This permits the links to mate properly when coupled as shown in FIG. 8C. As in the previously described embodiment, each link includes a plurality of locking slots 56 and locking pins 58 for locking the links together when assembled as shown in FIG. 8C.

Figure 9C:
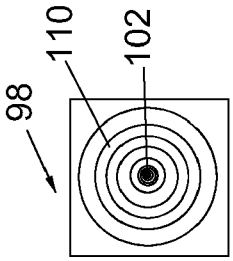
FIGS. 9A, 9B, and 9C illustrate an alternative embodiment of the drill segments for pushing a self-propelled drill bit.
Figure 9B:
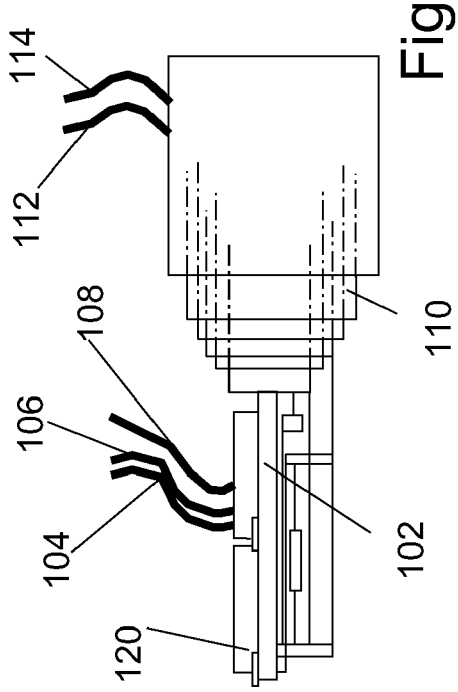
Figure 9A:
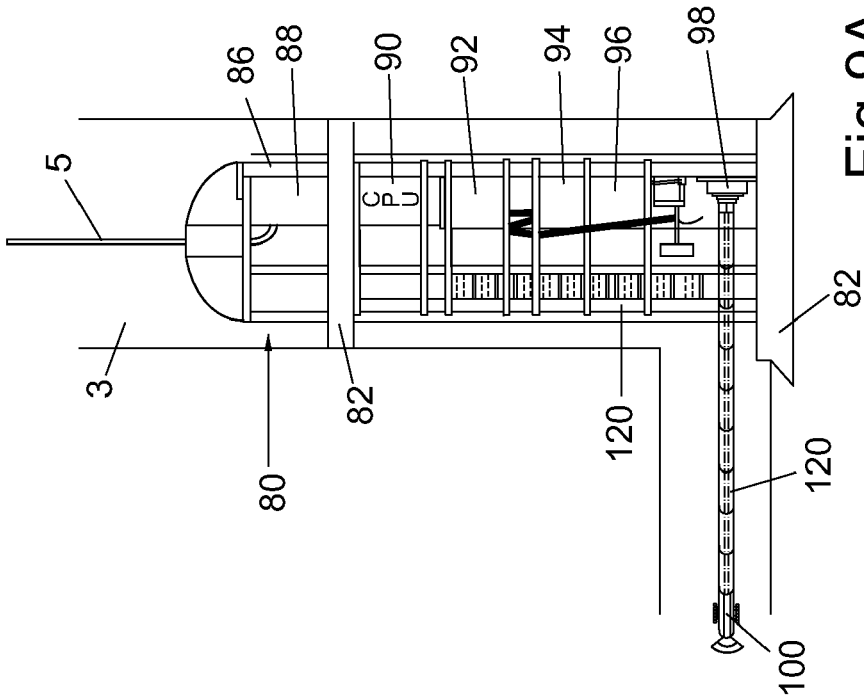

FIGS. 9A-9C show the housing assembly 80 adapted for housing and feeding links 120, and corresponds generally to FIGS. 7A-7C with like numbers referring to like parts.

Figure 10:
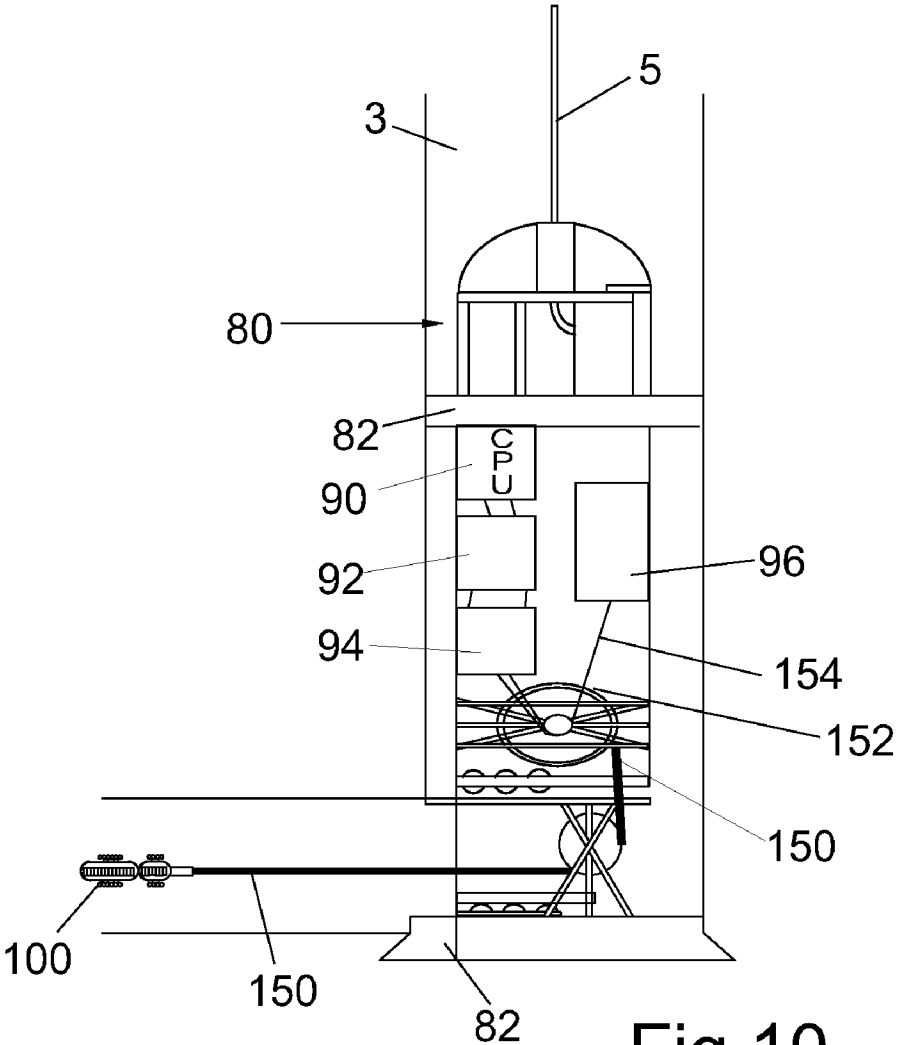
FIG. 10 is an alternative embodiment showing a tether assembly.

FIG. 10 illustrates an alternative embodiment wherein a tether 150 is mounted on a rotatable cylinder 152 for supplying fluids and power to the self-propelled drill bit 100. In this embodiment the tether is paid out from the cylinder by hydraulic drive via line 154 which is driven from the hydraulic fluid reservoir 96. The drilling fluids and electrical power is carried in the interior hollow bore of the tether.

Figure 11:
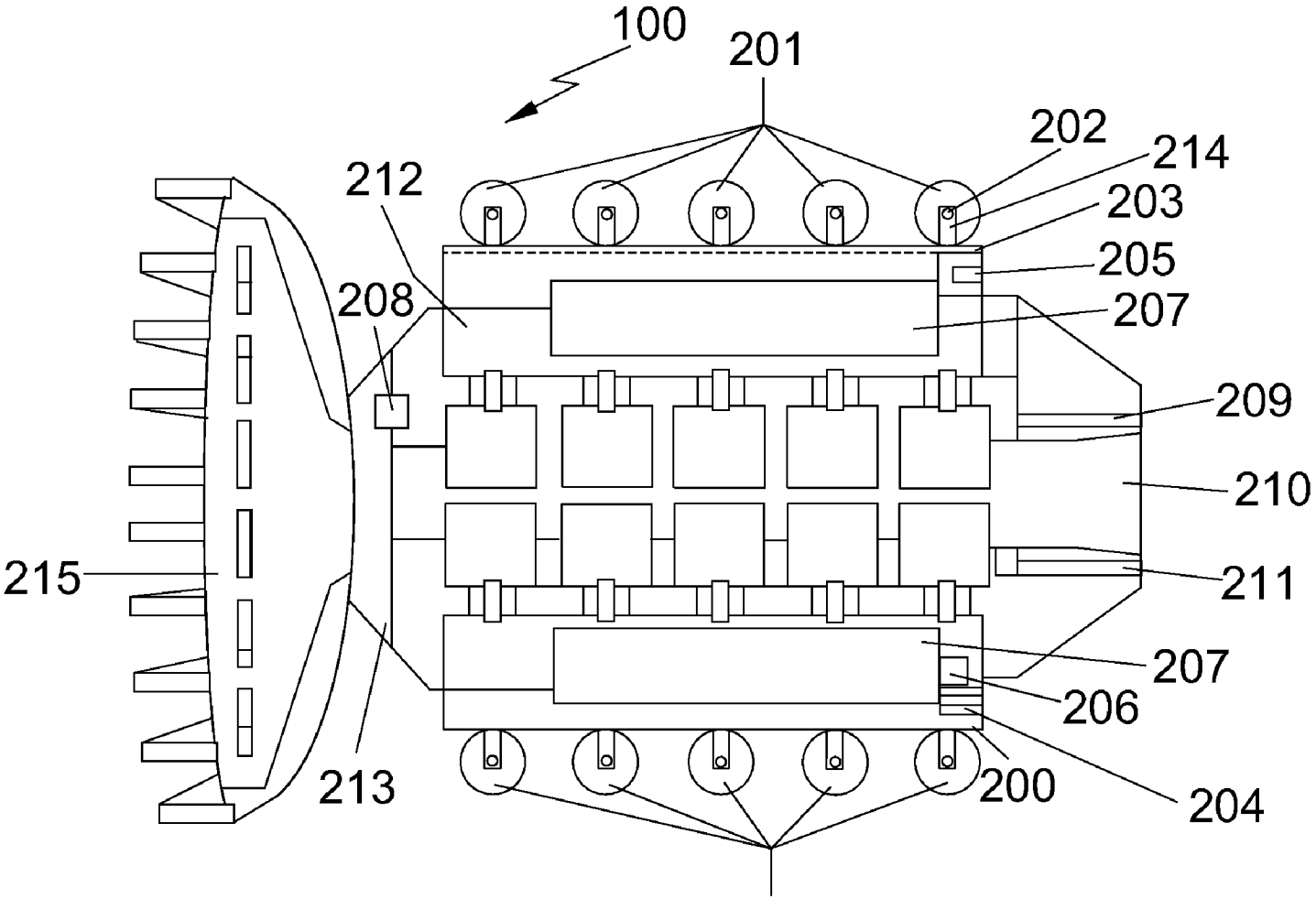
FIG. 11 illustrates a self-propelled drill bit and drive unit for use in accordance with the subject invention.

FIG. 11 shows one embodiment of a self-propelled drill bit 100 for use in combination with the link drive system of the subject invention. The drill bit has a main body or frame 200 for supporting a plurality of drive wheels 201 which are secured to drive wheel mounting brackets 214 by pins 202. An elongated screw 203 is driven by the drilling fluids introduced into the bit to turn and drive the wheels 201. The pin 204 drives the drive wheel screw by turning the worm gear 205 which is in communication with the screw 203. The gear 206 is in engagement with the worm gear 205 for providing high torque and high speed driving power to the worm gear. A high speed, high torque electric drive motor is shown at 207. The bit mechanism 215 is driven by the high torque and high speed bit drive gear 208. The electrical power to the motor 207 is provided by the plug boxes 209 and 211 which engage the link pins previously described. Drilling fluids are introduced into the bit via the open end cavity 210 from the central bore of the links as previously described. Electrical motor 212 provides the high torque and high speed drive for the bit mechanism 215 through the high speed, high torque gear 213.

While certain embodiments and features have been disclosed in detail herein, it should be understood the invention includes all enhancements and modifications within the scope and spirit of the following claims.

The invention claimed is:

1. An apparatus for drilling a horizontal borehole from a vertical wellbore, comprising:

a drill bit;

a plurality of hollow segments in the vertical wellbore, one of which is attached to the drill bit; and means for driving the drill bit laterally from the vertical wellbore through the hollow segments.

2. The apparatus of claim 1, wherein the segments are stored in an unattached manner within the wellbore and are sequentially attached to one another as the drill bit advance horizontally.

3. The apparatus of claim 2, further including a magazine of stacked segments in the wellbore.

4. The apparatus of claim 3, further including a load cell located at a position in the wellbore at which a horizontal perforation is desired, wherein each segment in the magazine of stacked segments drops into the load cell and is attached to the next adjacent segment as the drill bit horizontally advances.

5. The apparatus of claim 1, further including a power system coupled through segments and attached to the drill bit for driving the drill bit.

6. The apparatus of claim 1, wherein the hollow interior of the segments forms a fluid conduit for hydraulic fluid for driving the drill bit.

* * * * *